US006398410B1

(12) United States Patent
Guerra

(10) Patent No.: US 6,398,410 B1
(45) **Date of Patent: *Jun. 4, 2002**

(54) LAUNDRY BAG WITH A SLIDING ELEMENT

(76) Inventor: Luis Guerra, 68-09 Burns St., Apt E-2, Forest Hills, NY (US) 11375

( * ) Notice: Subject to any disclaimer, the term of this patent is extended or adjusted under 35 U.S.C. 154(b) by 0 days.

This patent is subject to a terminal disclaimer.

(21) Appl. No.: 09/779,077

(22) Filed: Feb. 8, 2001

(51) Int. Cl.[7] ..... B65D 33/14

(52) U.S. Cl. ..... 383/24; 383/2; 383/16; 383/72; 383/74; 383/117

(58) Field of Search ..... 383/2, 38, 72, 383/73, 74, 75, 76, 24, 16, 907

(56) References Cited

U.S. PATENT DOCUMENTS

| | | | | | |
|---|---|---|---|---|---|
| 2,510,186 | A | * | 6/1950 | Marsico et al. | 383/72 X |
| 2,552,443 | A | * | 5/1951 | Molinari | 383/72 X |
| 3,483,907 | A | * | 12/1969 | Corridon | 383/117 X |
| 4,674,664 | A | * | 6/1987 | Simon | 383/72 X |
| 4,974,967 | A | | 12/1990 | Tsuyoshi et al. | |
| D369,467 | S | * | 5/1996 | Cole | D3/300 |
| 5,746,514 | A | | 5/1998 | Orensten | |
| 6,224,259 | B1 | * | 5/2001 | Guerra | 383/72 X |

FOREIGN PATENT DOCUMENTS

| | | | | |
|---|---|---|---|---|
| DE | 3827841 | * | 2/1990 | 383/72 |
| EP | 000578247 A1 | * | 1/1994 | 383/72 |
| FR | 2621789 | * | 4/1989 | 383/2 |

* cited by examiner

*Primary Examiner*—Jes F. Pascua
(74) *Attorney, Agent, or Firm*—Collard & Roc, P.C.

(57) ABSTRACT

A laundry bag is provided that is comprised of an open end and a closed end having an excess of material therebetween. Also provided on the laundry bag are a loop and a drawstring. A sliding device is attached to the drawstring to allow opening and closing the bag. To assure that the proper amount of clothing is placed inside the bag, the laundry bag hangs from a support structure, by the provided loop and drawstring, in a folded manner. The open end of the bag is exposed for inserting clothing therein. Hanging the laundry bag in this folded position forms a front compartment that has an available laundry receiving volume of about 15% to 55%, and a rear compartment so that clothing can expand therein during the drying cycle.

9 Claims, 5 Drawing Sheets

LAUNDRY BAG WITH A SLIDING ELEMENT

BACKGROUND OF THE INVENTION

1. Field of the Invention

This invention relates to an improved laundry bag that can be used during washing and drying cycles. More specifically, the invention relates to a laundry bag that provides additional bag volume for expansion of wet clothing during the drying cycle and contains a sliding element for opening and closing the bag.

2. The Prior Art

Generally, laundry bags have been used to store soiled or dirty clothing until it is washed. A laundry bag is helpful for carrying clothing to the machine. Once ready for washing, the user would remove the clothing from the bag and place the clothing into the washing machine and then the dryer. However, the loss of articles during washing has created a need for a washable laundry bag. To alleviate this problem, there are laundry bags that store dirty laundry and can be washed therewith.

U.S. Pat. No. 5,746,514 to Orensten discloses a spherical laundry bag that can be used during the washing cycle. This bag contains a closure that allows the bag to maintain its spherical shape without interfering with the interior volume.

Additionally, U.S. Pat. No. 4,974,967 to Tsuyoshi et al. shows a laundry net in the form of an octahedron. This construction permits water to uniformly flow through the bag, irrespective of its position with respect to the flow of water.

The disadvantage of these laundry bags is that the clothing inside the bag is not properly cleaned or dried. This is due to the lack of excess space within the bag for the clothing to expand during the drying cycle. The abovementioned references do not provide adequate additional space for this expansion, and therefore, clothing will be wrinkled due to the inadequate excess volume within the laundry bag. U.S. patent application Ser. No. 09/502,929 to Guerra discloses an improvement on the abovementioned bags, and is hereby incorporated by reference.

SUMMARY OF THE INVENTION

Accordingly, it is an object of the present invention to provide a laundry bag with sufficient excess volume to allow for the expansion of laundry during the drying cycle.

It is another object of the present invention to provide a laundry bag that hangs in such a way as to permit only a designated portion of the bag to be filled with clothing.

It is a further object of the present invention to provide a laundry bag that maintains its open position while placing dirty clothing therein and further comprises a sliding device for opening and closing the bag.

These and other objects are accomplished by a laundry bag comprising an open end and a closed end. The laundry bag is preferably egg shaped and made from a perforated mesh material. This mesh material is similar to that of the lining of men's swimming trunks. The material is durable and light weight. It also dries quickly and therefore does not add any appreciable time to the drying cycle. The laundry bag is constructed with an excess of material having many pleats and gathers so that it readily expands when clothing is added.

A loop and drawstring are attached to the laundry bag. The loop and drawstring are each made of a material that can withstand the force from the loaded hanging laundry bag. They are preferably made of a polyester fiber cord.

There is a drawstring located adjacent to the open end and it is moveably coupled to the open end. The second loop is located adjacent to the closed end. A hand can slip through the loop and drawstring which act as handles for transporting the laundry bag.

The drawstring contains a sliding device for opening and closing the laundry bag. This sliding device consists of at least one tubular element disposed around the drawstring. A piece of material is placed over the tubular elements for ease in grasping the sliding device and to support the bag.

To assure that the proper amount of clothing is placed inside the bag, the laundry bag hangs from a supporting structure, by the provided loop and drawstring, in a folded manner. Folding the bag creates a front first compartment and a rear second compartment. The front compartment receives laundry through the open end. This front compartment has a laundry receiving volume of about 15% to 45% of the total bag volume, so that the washed clothing can expand into the remaining bag volume during the drying cycle.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
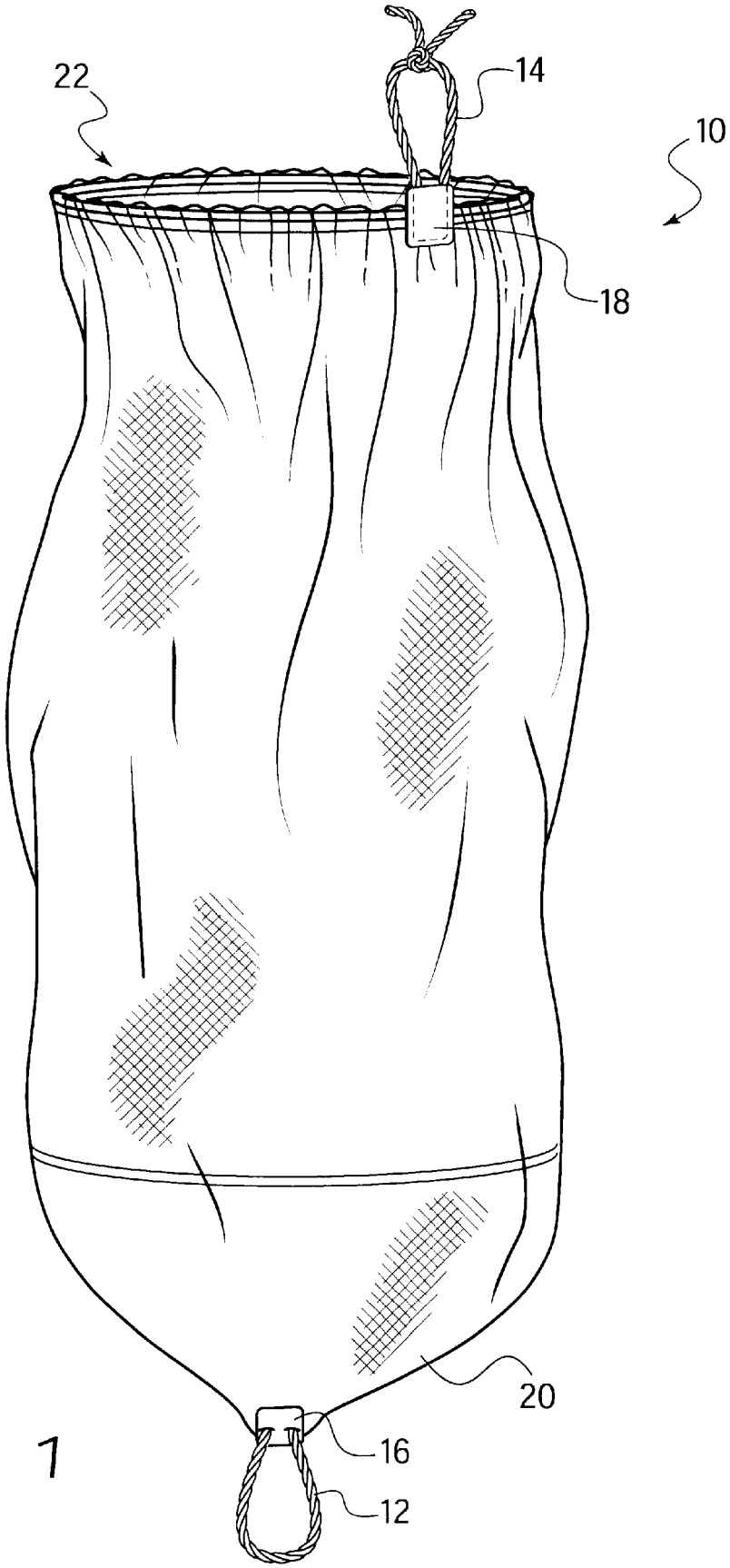
FIG. 1 shows the laundry bag according to the present invention.

Referring now in detail to the drawings and, in particular FIG. 1, there is shown a laundry bag 10. A loop 12 is located at closed end 20, and a drawstring 14 is located at open end 22. Drawstring 14 is moveably coupled to open end 22 and contains a sliding device 18 used for opening and closing bag 10. Drawstring 14 is pulled through sliding device 18 to open and close laundry bag 10. Applying pressure to sliding device 18 and pulling the drawstring pleats the open end until it closes, and maintains the laundry bag in its closed position during transport, washing and drying. Pressure can be applied to sliding device 18 to re-open the laundry bag. Loop 12 and drawstring 14 can also be used as handles to carry the laundry bag.

A section of stiff material 16 is attached to the closed end at loop 12. The section of stiff material provides durability to loop 12 so that it can withstand the weight of bag 10 when loaded. Section of stiff material 16 can be made of leather, heavy cotton or any other suitable material. A pocket (not shown) may be located inside laundry bag 10, near the open end, and is used for carrying detergent pellets or change.

Figure 2:
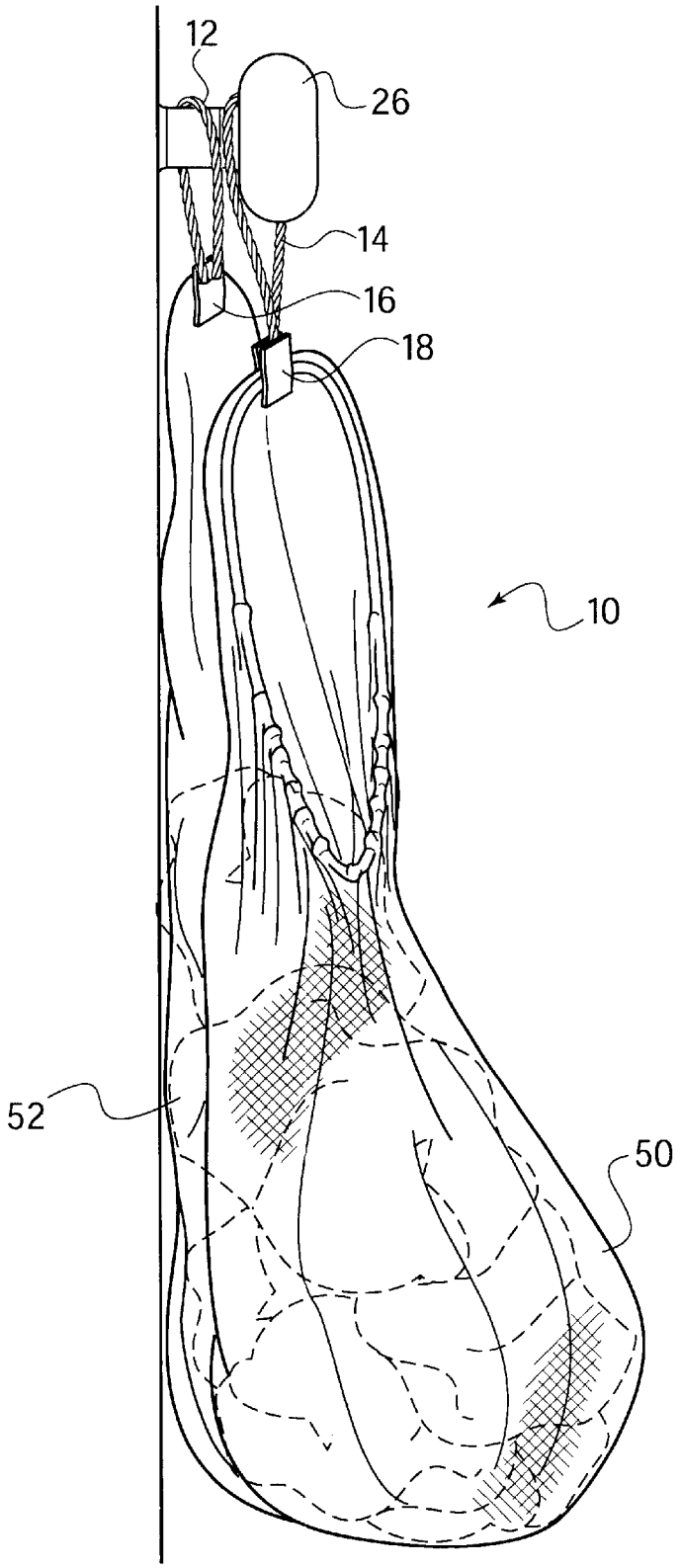
FIG. 2 shows a side view of the laundry bag containing clothing, in its hanging position.

FIG. 2 show laundry bag 10 hanging from a supporting structure 26, such as a door knob. Loop 12 is placed onto supporting structure 26, and then an end of drawstring 14 is placed onto the supporting structure. Hanging the laundry bag in this folded position forms a front compartment 50 and a rear compartment 52. Front compartment 50 provides an available laundry receiving volume of about 15% to 55%. Rear compartment 52 allows laundry to expand therein during the drying cycle. Laundry is inserted through the open end.

Figure 4:
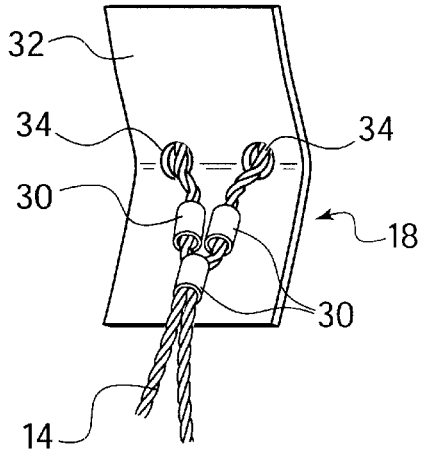
FIG. 4 shows the sliding device according to the invention.
Figure 5:
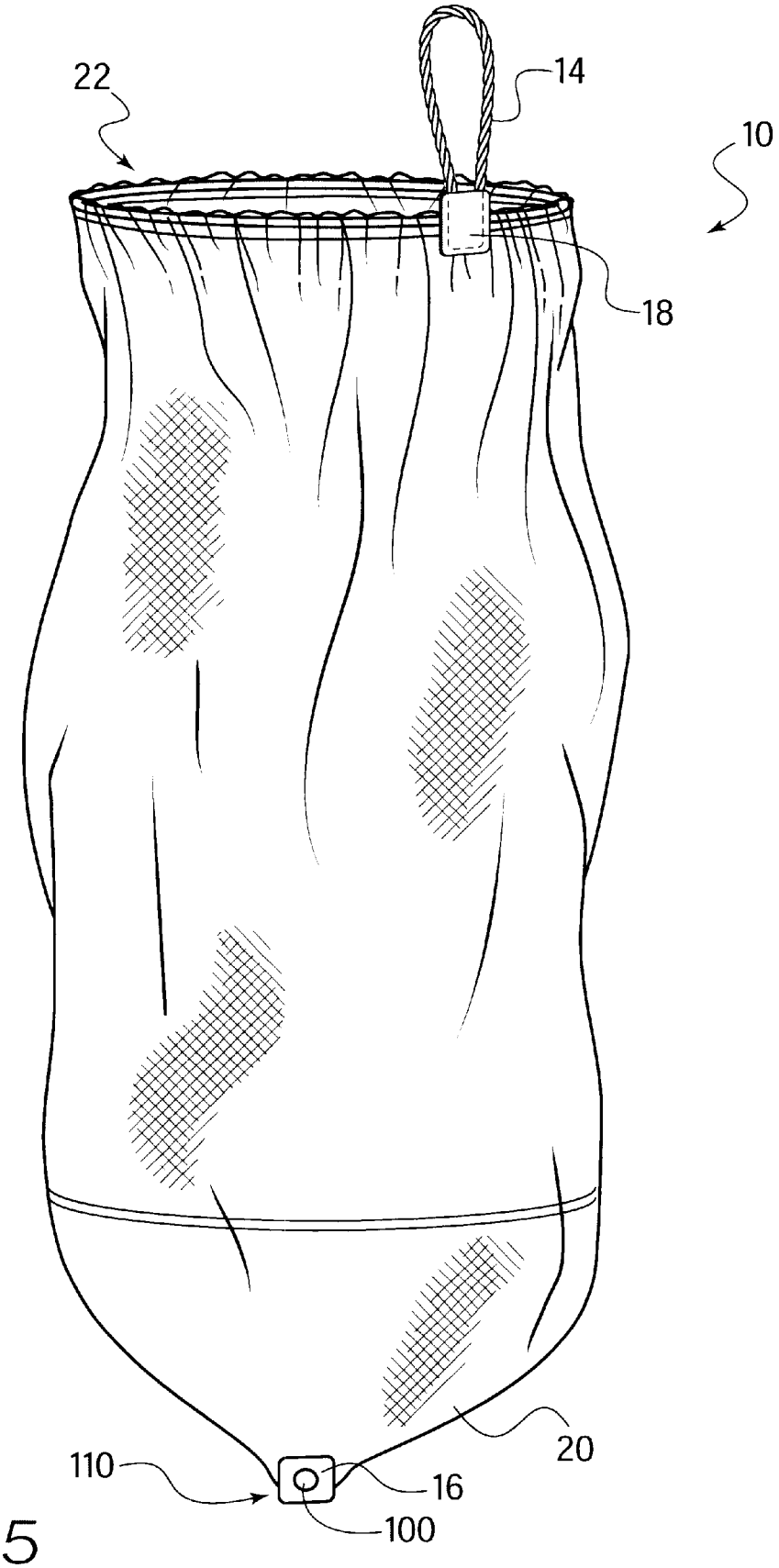
FIG. 5 shows another embodiment of the laundry bag.

FIG. 4 shows sliding device 18 attached to drawstring 14. Sliding device 18 contains at least one tubular element 30. In a preferred embodiment, there are three tubular elements 30 disposed around drawstring 14 forming a triangular shape. Drawstring 14 slides through tubular elements 30 allowing drawstring 14 to open or close bag 10. When slider device 18 is stationary, drawstring 14 can not move through tubular elements 30 due to frictional forces, thereby locking drawstring 14 in place. This provides the advantage of maintaining bag 10 in its open or closed position. A section of material 32 is wrapped around tubular elements 30 for easier gripping of tubular elements 30 and is stitched to the laundry bag for support. Section of material 32 contains two apertures 34 that allow drawstring 14 to slide therethrough.

In another embodiment, sliding device 18 is made of a tubular element having two pairs of apertures disposed parallel to each other. Drawstring 14 extends through apertures allowing drawstring 14 to slide therethrough. In another embodiment, the sliding device can be a wooden element having a pair of apertures through which drawstring 14 slides through, thereby opening or closing bag 10.

In operation, the user applies pressure to tubular elements 30. This allows tubular elements 30 to slide up and down drawstring 14 for opening and closing bag 10. When pressure is not applied to tubular elements 30, a frictional force will maintain the sliding device in its position.

Figure 3:
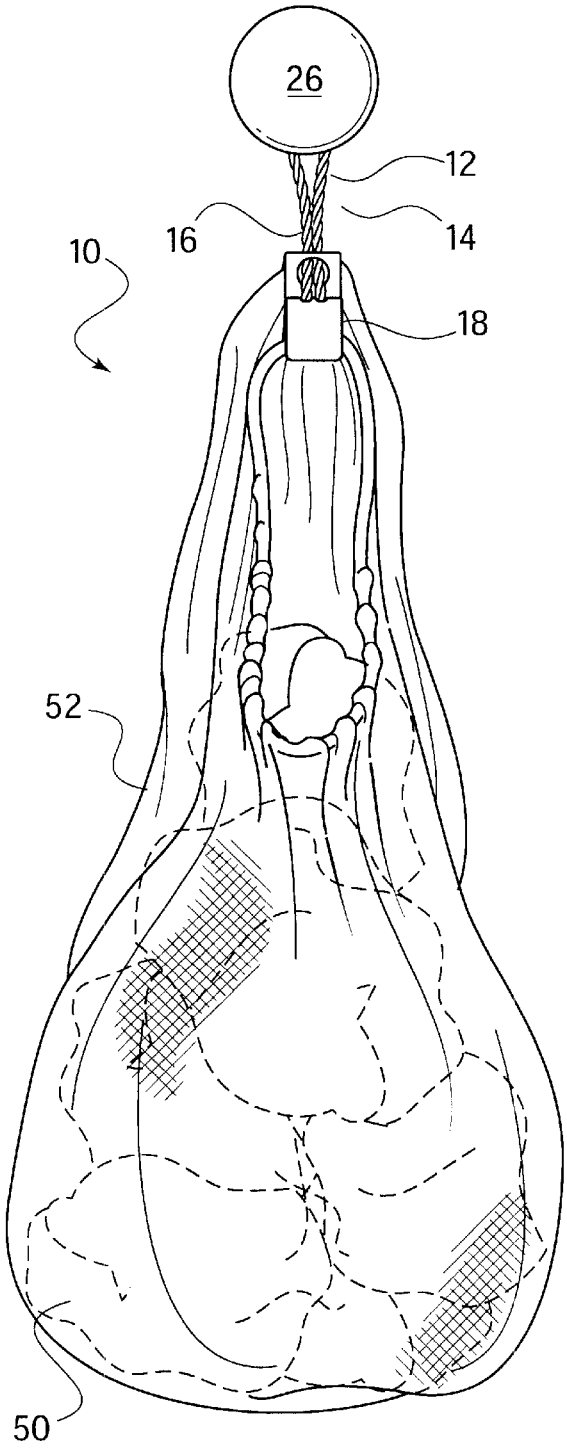
FIG. 3 shows a front view of another embodiment of the laundry bag in its hanging position.
Figure 6:
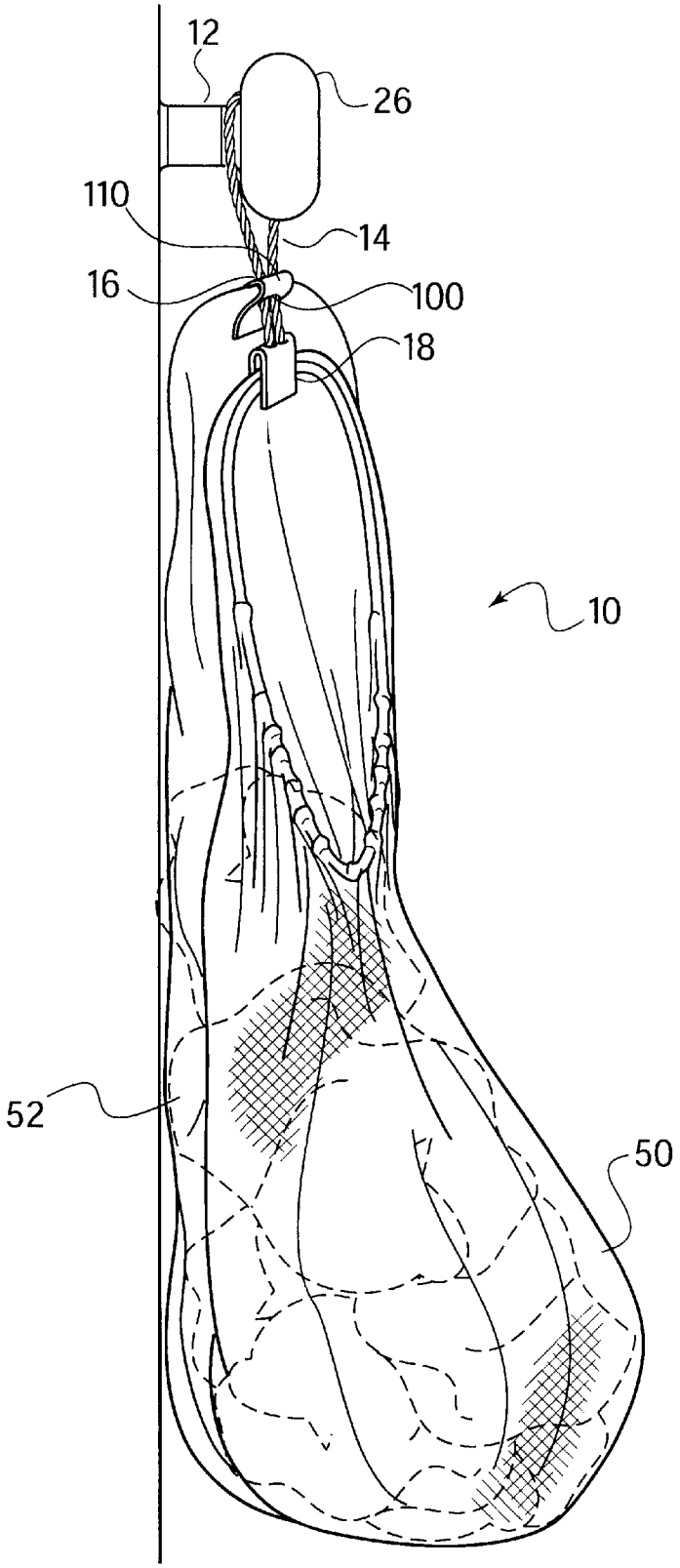
FIG. 6 shows a side view of the laundry bag of FIGS. 3 and 5 containing clothing, in its hanging position.

In another embodiment of the invention, laundry bag 10 contains two apertures 100,110 at its bottom end 20. A section of stiff material 16 is disposed over apertures 100, 100 and contains corresponding apertures. As shown in FIGS. 3 and 6, drawstring 14 slides through apertures 100,110 and is then placed on supporting structure 26.

Accordingly, while only a few embodiments of the present invention have been shown and described, it is obvious that many changes and modifications may be made thereunto without departing from the spirit and scope of the invention.

What is claimed is:

1. An egg-shaped laundry bag for storing clothing while hanging on a support structure and for holding clothing during washing and drying cycles, comprising:

an open end for receiving clothing;

a closed end connected to said open end by an excess of draping material, such that when the bag is hung on the support structure, a front compartment and a rear compartment are formed, wherein said rear compartment allows adequate expansion space during the drying cycle;

a drawstring having two ends moveably coupled to said open end for opening and closing the bag and for hanging the bag on the support structure;

a loop attached to said closed end for hanging the bag on the support structure; and a sliding device disposed on said drawstring for securing the bag in an open and closed position, wherein the laundry bag hangs by said drawstring and said loop, in a folded manner, exposing said open end, creating an available laundry receiving volume in said front compartment of about 15% to 55% of total bag volume.

2. The laundry bag according to claim 1, wherein said sliding device comprises:

least one tubular element disposed around said drawstring; and a piece of material wrapped around said at least one tubular element, said piece of material comprising at least two apertures allowing said drawstring to slide therethrough when moving said sliding device;

wherein pressure is applied to said at least one tubular element allowing said tubular element to slide up and down said first loop for opening and closing the bag.

3. The laundry bag according to claim 2, wherein said at least one tubular element is made of plastic.

4. The laundry bag according to claim 2, wherein said at least one tubular element comprises three tubular elements disposed around said drawstring creating a triangular formation.

5. An egg-shaped laundry bag for storing clothing while hanging on a support structure and for holding clothing during washing and drying cycles, comprising:

an open end for receiving clothing;

a closed end connected to said open end by an excess of draping material, such that when the bag is hung on the support structure, a front compartment and a rear compartment are formed, wherein said rear compartment allows adequate expansion space during the drying cycle;

a drawstring moveably coupled to said open end for opening and closing the bag and for hanging the bag on the support structure;

a piece of material having a set of apertures and attached to a center area of said closed end, wherein said set of apertures receive said drawstring; and a sliding device disposed on said drawstring for securing the bag in an open and closed position;

wherein the laundry bag hangs by said drawstring, in a folded manner, exposing said open end, creating an available laundry receiving volume in said front compartment of about 15% to 55% of total bag volume.

6. The laundry bag according to claim 5, wherein said sliding device comprises:

at least one tubular element disposed around said drawstring; and a piece of material wrapped around said at least one tubular element, said piece of material comprising at least two apertures allowing said drawstring to slide therethrough when moving said sliding device;

wherein pressure is applied to said at least one tubular element allowing said tubular element to slide up and down said first loop for opening and closing the bag.

7. A method of using an egg-shaped laundry bag having an open end with a drawstring and closed end with a loop, for storing clothing while hanging on a support structure and holding clothing during washing and drying cycles, comprising:

hanging the laundry bag on the support structure by the drawstring and the loop so that a front and a rear compartment are formed by a fold in the laundry bag;

making pleats and gathers and pushing the pleats and gathers down towards the drawstring so that said front compartment remains in an opened position for inserting clothing therein;

filling said front compartment with laundry;

placing the laundry bag in a washing machine; and placing the laundry bag in a drying machine;

removing the bag from the drying machine a removing the clothing from the bag.

8. The method according to claim 7, wherein when the laundry machine is a top loader with an agitator, the open end is placed around the agitator to secure the laundry bag in place.

9. A method of using an egg-shaped laundry bag having an open end with a drawstring and closed end with two apertures, for storing clothing while hanging on a support structure and holding clothing during washing and drying cycles, comprising:

placing the drawstring through the two apertures;

hanging the laundry bag on the support structure by the drawstring so that a front and a rear compartment are formed by a fold in the laundry bag;

making pleats and gathers and pushing the pleats and gathers down towards the drawstring so that said front compartment remains in an opened position for inserting clothing therein;

filling said front compartment with laundry;

placing the laundry bag in a washing machine; and placing the laundry bag in a drying machine.

* * * * *